United States Patent [19]

Larsen

[11] Patent Number: 4,541,476

[45] Date of Patent: Sep. 17, 1985

[54] PLANT FOR THE PRODUCTION OF VERTICALLY DIVIDED FLASKLESS CASTING MOULDS AND INCLUDING EQUIPMENT FOR PATTERN BOARD EXCHANGE

[75] Inventor: Laurits A. B. Larsen, Veddelev, Denmark

[73] Assignee: Dansk Industri Syndikat A/S, Herlev, Denmark

[21] Appl. No.: 632,275

[22] Filed: Jul. 20, 1984

Related U.S. Application Data

[63] Continuation of Ser. No. 347,285, Feb. 9, 1982, abandoned.

[30] Foreign Application Priority Data

Feb. 20, 1981 [DK] Denmark ..... 783/81

[51] Int. Cl.[4] ..... B22C 17/00

[52] U.S. Cl. ..... 164/182; 164/207; 164/214; 164/323

[58] Field of Search ..... 164/182, 200, 201, 207, 164/210, 213, 214, 227, 323

[56] References Cited

U.S. PATENT DOCUMENTS

| | | | |
|---|---|---|---|
| 3,008,199 | 11/1961 | Jeppesen | 164/22 |
| 3,901,304 | 8/1975 | Jacobsen | 164/159 |
| 3,967,672 | 7/1976 | Wallwork | 164/227 X |

FOREIGN PATENT DOCUMENTS

| | | | |
|---|---|---|---|
| 531632 | 12/1976 | U.S.S.R. | 164/213 |

*Primary Examiner*—Nicholas P. Godici
*Assistant Examiner*—Richard K. Seidel
*Attorney, Agent, or Firm*—Larson and Taylor

[57] ABSTRACT

In a plant for the production of vertically divided casting moulds consisting of flaskless mould parts, produced successively in a pressing chamber having pressing plates carrying exchangeable pattern boards. Carriers are arranged laterally of the pressing chamber with a view to allowing a quick changing of said pattern boards, one of the carriages serving to automatically feed and insert "new" pattern boards while the other one picks up and pulls away "used" pattern boards. The various operations are controlled by an electronic control system in dependence on a code on the pattern boards whereby to reduce waste of time to a minimum and avoid risk involving manual operations.

3 Claims, 2 Drawing Figures

PLANT FOR THE PRODUCTION OF VERTICALLY DIVIDED FLASKLESS CASTING MOULDS AND INCLUDING EQUIPMENT FOR PATTERN BOARD EXCHANGE

This application is a continuation of application Ser. No. 347,285 filed Feb. 9, 1982, abandoned.

BACKGROUND AND PURPOSE OF THE INVENTION

Inter alia U.S. Pat. No. 3,901,304 discloses a special truck to be used when exchanging pattern boards in an automatic apparatus for producing casting moulds as disclosed in U.S. Pat. No. 3,008,199. This apparatus has vertical joints between flaskless mould parts. Each mould part is produced successively by compaction of sand or the like between a pair of pattern boards supported by opposed pressing plates in a pressing chamber. After a mould part has been pressed the rear pressing plate and pattern board are moved so that a further movement of the front pressing plate and pattern board causes the mould to be transferred to a casting bed or conveyor and run up to its predecessor to form a casting cavity at the joint of both mould parts.

The truck referred to comprises at least one pair of transversely displaceable pattern board carriers that can be aligned with their respective pressing plate to which the pattern boards are locked in their position of use. After said locks have been released, the pattern boards can be manually pulled onto the carriers of the truck and brought to stock, from where another pair of pattern boards can be brought into the exchange position in relation to the pressing plates and transferred thereto and locked thereon.

To accelerate the exchange the truck may include two pairs of pattern board carriers, namely one pair for receiving the pattern boards hitherto used, and another pair for delivering another set of pattern boards, but even in this case a certain loss in production must be accounted for, because the exchange normally takes at least 3 minutes and frequently 6 to 8 minutes. Moreover, the changing operation requires a not quite ignorable manual work.

These circumstances are tolerated when casting in long series is concerned which only requires a few pattern board exchanges a day, but in order to reduce storage capacity and to allow quicker intervening in case casting errors are found, far more frequent exchanges are often desired, for instance up to 10 exchanges an hour, and such a desire cannot be complied with in an economically proper manner by use of the above mentioned truck.

Against this background it is a purpose of the invention to provide a plant which renders it possible to effect the pattern board exchange in a fraction of the time needed so far and with a minimum of manual work.

SUMMARY AND PARTICULAR ADVANTAGES OF THE INVENTION

More particularly, the invention relates to a plant for the production of vertically divided casting moulds consisting of flaskless mould parts of sand or similar material to be compacted between opposed pressing plates with exchangeable pattern boards in a pressing chamber from which the mould parts are fed pari passu with their production to and lined up on a casting bed, the plant further including a pattern board exchange equipment comprising a carriage positioned at one side of the pressing chamber and being movable parallel to the axis thereof between a loading station for pattern boards to be inserted and a delivery position opposite the pressing plate, the pattern board of which is to be exchanged. The plant according to the invention differs from the prior art in that the exchange equipment further comprises another carriage located at the opposite side of the pressing chamber and arranged to receive and remove the hitherto used pattern board of the pressing plate concerned, the operation of said two carriages being coordinated by a control system adapted to be activated by codes provided on the pattern boards.

In such a plant the exchange of a pattern board only need increase the normal cycle time by a maximum of 40 seconds, so that close to 10 exchanges may be effected during the same time of loss hitherto spent on a single exchange operation.

This is substantially due to the fact that the insertion of a "new" pattern board from the first carriage may take place essentially concurrently with removing the "old" pattern board by means of the other carriage but a further and highly contributory cause is that the necessary operations can be started automatically by the said codes on the pattern boards. Modern casting plants of the kind dealt with in the foregoing already include a data controlled electronic system for automatically adjusting a series of parameters, such as the filling of the pressing chamber, the starting position of the pressing plates and their movements of displacement as well as the amount of casting material to be poured, and the invention offers the possibility of utilizing the same control system also for pattern board exchange so as to keep waste of time much lower compared to manual operations and so as to improve safety conditions for the personnel involved. The signals derived from the control system may in an ordinary manner be converted to coordinated movements of the two carriers, not only as far as their travelling to and from the exchange position is concerned, but also as far as the proper pattern board exchange is concerned, including releasing and relocking the above mentioned pattern board locks.

With a view to the actual changing operation the receiving carriage may comprise at least one pattern board carrier which from its position of rest in the carriage is movable transversely to the axis of the pressing chamber to a receiving position in immediate connection with the pressing plate, the pattern board of which is to be changed and, further, a gripping device cooperating with a guide pin on the pattern boards and adapted to transfer the pattern board from the pressing plate to the carrier of the receiving carriage. The carriers as well as the gripping devices may be activated hydraulically, pneumatically, mechanically or electrically in dependence on signals received from the control system so as to require no manual efforts at all.

The plant may further comprise a pattern boards storage located on the same side of the pressing chamber as the first carriage and associated with a conveyor for transferring the pattern boards selected from the storage to the loading station of the first carriage. Only at this place in the plant an operator is needed, namely to select the appropriate pattern boards from the storage and to code the number of mould parts desired to be produced prior to the subsequent pattern board changing.

Though it may occur that only one of two concurrently used pattern boards is to be changed, the changing operation will normally include both pattern boards, and for this reason it is preferred that either of the carriages comprises two pattern board carriers for a respective one of two associated pattern boards. In certain cases it may even be advantageous to provide at least the first carriage with more than two such carriers, for instance carriers for two complete sets of pattern boards.

DETAILED DESCRIPTION OF THE PREFERRED EMBODIMENT

Figure 1:
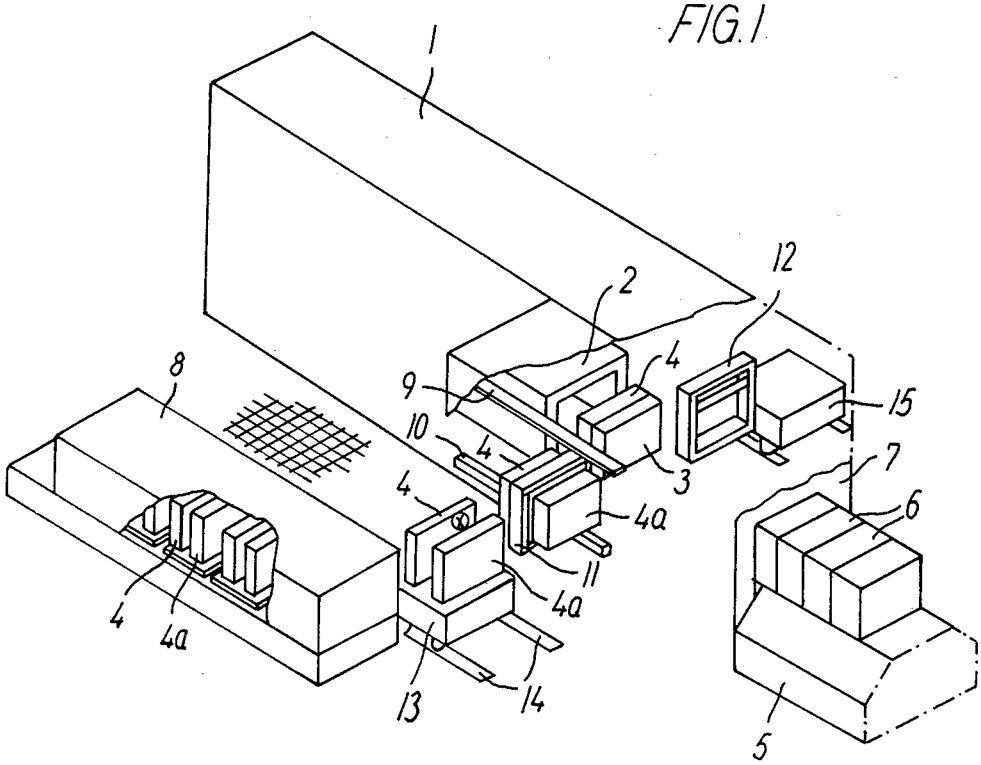
FIG. 1 illustrates a simplified perspective view of a preferred embodiment of the invention with certain details left out, in particular some parts of protective coverings applied to the components of the plant, and FIG. 2 a front view of the pressing chamber of the plant and a pressing plate displaceable therein and carrying a pattern board immediately before its being picked up by means of one of the above mentioned two carriages.
Figure 2:
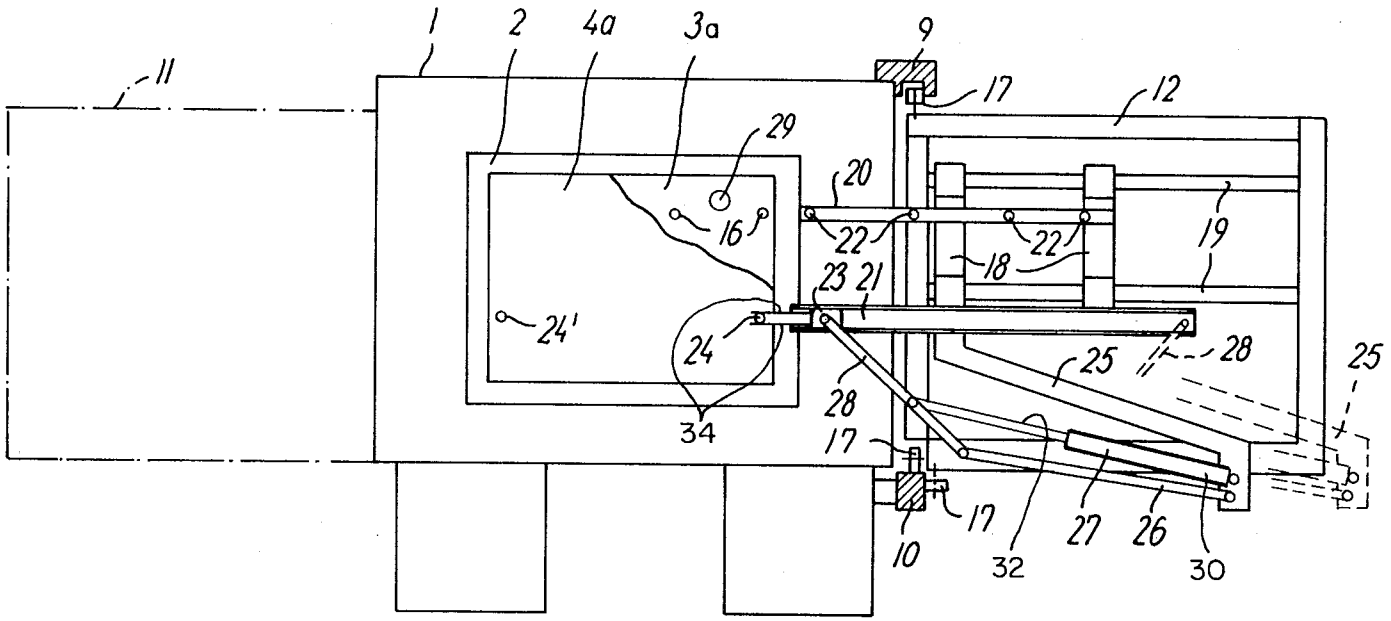

The plant in FIG. 1 comprises an apparatus 1, known per se (see for example, U.S. Pat. No. 3,008,199 mentioned above), having a pressing chamber 2 with two associated pressing plates 3, 3*a*, one of which, 3*a*, however, is hidden within the chamber while the other one, 3, is pulled free thereform with a view to changing the pattern board 4 used so far. Subsequently, when pressing plate 3 is hidden, pressing plate 3*a* is free so that used pattern board 4*a* can be changed (as shown in FIG. 2). The plant further comprises a likewise known casting bed or conveyor 5 on which the mould parts 6 successively produced in the pressing chamber are lined up to form a stepwise advanced casting mould coming out from a gate in the front wall 7 of the apparatus 1, and a preferably heated storage 8 for pattern boards 4 and 4*a* grouped in pairs and intended for their respective one of said two pressing plates 3, 3*a*.

The side of the apparatus 1 that faces the storage 8 supports an upper guiding rail 9 and a lower guiding rail 10 for a frameshaped carriage 11 movable parallel to the axis of the pressing chamber 2, and a fully analogous carriage 12 is analogously displeaceably suspended on the opposite side of the apparatus 1. In the situation illustrated on the drawing both carriages 11 and 12 are in lateral alignment with the pressing plate 3, the pattern board of which is to be changed by transference of the used pattern board to carriage 12 and the transference of a new pattern board from carriage 11. The position of the pressing plate 3 and thus also the positions of the carriages in this exchange situation may vary within certain limits and the carriages 11 and 12 are, moreover, movable to a loading station (carriage 11) and a delivery station (carriage 12), respectively after transference is completed. On the drawings said stations are illustrated as being coincident with the exchange positions, but this is normally not the case because it is usually desired to have free accessibility to the space in front of the pressing chamber 2 with a view to inspection of the newly formed mould parts and insertion of cores, if needed.

In the illustrated embodiment a conveyor in the form of a trolley 13 is arranged between the storage 8 and the carriage 11, said trolley 13 travelling on floor rails 14 and thus easily moved from a position laterally opposite the set of pattern boards 4, 4*a* to be selected from the storage to a position laterally opposite the carriage 11 when in its loading position. A similar conveyor or trolley 15 may be arranged to receive the exchanged pattern boards from the carriage 12.

FIG. 2 shows the pressing plate 3*a* which is hidden in FIG. 1 after it has been moved out to occupy the position which pressing plate 3 occupies in FIG. 1, and on its forward facing side carries a pattern board 4*a* to be changed. This pattern board 4*a* is suspended so as to be laterally displaceable on a horizontal series of rollers 16 and is under normal use fastened to the pressing plate by means of ordinary releasable locks, not shown on the drawings. Through wheels 17 the carriage 12 serving to pick up the pattern board 4*a* runs on the rails 9 and 10 on which it has been moved into a position laterally opposite the pressing plate 3*a* and a slide 18 displaceable on horizontal guides 19 in the carriage 12 is shifted laterally by a suitable means (not shown) to a position in which a pair of rails 20 and 21 on the slide 18 extends to or approximately to the adjacent lateral edge of the pressing plate 3*a*.

The rail 20 is a pattern carrier with rollers 22 positioned in alignment with the rollers 16 of the pressing plate, while the rail 21 is a guide rail for gripping device 23 with jaws 34. Jaws 34 are suitably operated and in the illustrated situation have seized a guide pin 24 on the pattern board 4*a*. A similar guide pin 24′ is located at the opposite edge of the pattern board to cooperate with a corresponding gripping device belonging to the carriage 11. This carriage may be constructed quite similar to the carriage 12 and is therefore not shown in detail.

The slide 18 comprises a rigid arm 25 which by the displacement of the slide 18 by the suitable means (not shown) is moved between the position shown in unbroken lines and the withdrawn position shown in dotted lines. At its lower end the arm 25 is pivotally connected with a linkage 26 of fixed length and with a hydraulic pneumatic cylinder 30 having a piston rod 32 forming a variable length linkage 27. Said two linkages 26 and 27 are further respectively pivotally connected with the lower end and with an intermediate point of a third linkage 28 the upper end of which is pivotally connected with the gripping device 23. On shortening the linkage 27 by withdrawing piston rod 32 into cylinder 30, gripping device 23 will consequently be pulled to the right on the guide rail 21 and will in its end position have shifted the pattern board 4*a* on to the carrier rail 20 from rollers 16 of pressing plate 3*a*. Pattern board 4*a* together with the guide rail 21 will then be pulled into the carriage 12 by the reverse movement of the slide 18 such that the carriage 12 may now be moved on the rails 9 and 10 to leave the exchange position.

As soon as the withdrawal of the pattern board 4*a* has started a "new" pattern board from the carriage 11 may be shifted on to the rollers 16 of the pressing plate 3*a* by quite analogous operations so that all the changing procedures may be carried out in a very short time. Add to this the circumstances that all operations, including adjusting the carriages 11 and 12, the displacement of their slides 18, the activating and releasing of the pattern board locks, and the activation of the gripping devices 23, may be controlled by an electronic control system, not shown, including a reading cell 29 incorporated in the pressing plate and reacting on a code "x", FIG. 1, on the pattern boards 4. In this case the only obligation upon the operator is to select the desired pattern boards from the storage 8 and to record the required number of mould parts in the control system which subsequently takes over the responsibility for effecting the pattern board changing at the proper time and in an accurate manner, inter alia in such a manner that the mould parts production is resumed only after the "new" pattern board or boards have been locked in correct position.

It will be understood that either of the carriages 11 and 12 may have one, two or possibly more slides 18 with associate carrier and guide rails 20, 21 etc. adapted to manage at least one pair of associated pattern boards 4, 4*a*. For example, FIG. 1, which shows two pattern boards represents diagramatically a carriage having two slides 18 for moving separate pattern boards successively, while the carriage shown in FIG.2 has only a single slide 18.

I claim:

1. A pattern board exchange mechanism in combination with a device for producing flaskless foundry moulds having a mould part pressing chamber and a casting bed to successively receive the mould parts from the pressing chamber and to thereby form a continuous vertically divided and intermittently advanced set of moulds, the pattern board exchange mechanism comprising:

a pair of opposed pressing plates having exchangeable pattern boards for use in the pressing chamber, said pressing plates and associated exchangeable pattern boards being movable relative to the pressing chamber to a pattern board exchange position;

a first carriage guided for movement along one side of the pressing chamber between (a) a pattern board loading position where a new pattern board is loaded on said first carriage and (b) a pattern board transfer position adjacent one of said pressing plates when said one pressing plate is located in the pattern board exchange position where the new pattern board is transferred to said one pressing plate;

a first transfer means located on said first carriage for transferring the new pattern board from said first carriage to said one pressing plate;

a second carriage guided for movement along the opposite side of the pressing chamber between (a) a pattern board transfer position adjacent said one pressing plate when said one pressing plate is located in the pattern board exchange position where a used pattern board is transferred from said one pressing plate and (b) a pattern board delivering position where the used pattern board is unloaded from said second carriage;

a second transfer means located on said second carriage for transferring the used pattern board from said one pressing plate to said second carriage; and a carriage operation control system sensitive to codes provided on said pattern boards.

2. A pattern board exchange mechanism as claimed in claim 1 wherein each pattern board is provided with an outstanding pin;

wherein said pressing plates include horizontal pattern board supporting rollers; and wherein both said first and second transfer means include (a) a pattern board carrier rail which is displaceable between a rest position within said respective carriage and an extended position, said carrier rail including pattern board supporting rollers thereon such that when said carrier rail is in the extended position with said respective carriage in the transfer position adjacent said one pressing plate in the pattern board exchange position, said pattern board supporting rollers of said respective carriage are horizontally aligned with said pattern board supporting rollers of said pressing plate to form a transfer path, and (b) a horizontally displaceable gripping device which is engageable with said pin of the pattern board to shift the pattern board along the transfer path as said gripping device is displaced.

3. A pattern board exchange mechanism as claimed in claim 1 and further including a pattern board storage provided on the same side of the pressing chamber as said first carriage and a conveyor for pattern boards which is arranged between said storage and the loading position of said first carriage.

* * * * *